United States Patent [19]

Goller et al.

[11] Patent Number: 4,723,423

[45] Date of Patent: Feb. 9, 1988

[54] FLAT-BED KNITTING MACHINE HAVING AN ELECTRONIC CONTROL FOR THE MOVEMENT OF THE NEEDLE SINKER

[75] Inventors: Ernst Goller, Reutlingenl; Jürgen Ploppa, Pfullingen; Thomas Stoll, Reutlingenl; Fritz Walker, Kusterdingen, all of Fed. Rep. of Germany

[73] Assignee: H. Stoll GmbH & Co., Fed. Rep. of Germany

[21] Appl. No.: 6,260

[22] Filed: Jan. 20, 1987

Related U.S. Application Data

[63] Continuation of Ser. No. 657,855, Oct. 5, 1984, abandoned.

[30] Foreign Application Priority Data

Oct. 6, 1983 [DE] Fed. Rep. of Germany ..... 3336368

[51] Int. Cl.[4] ..... D04B 7/10

[52] U.S. Cl. ..... 66/71; 66/78; 66/75.2

[58] Field of Search ..... 66/78, 75.2, 77, 71

[56] References Cited

U.S. PATENT DOCUMENTS

| | | | |
|---|---|---|---|
| 3,012,424 | 12/1981 | Wullimann | 66/77 |
| 3,065,509 | 12/1962 | Kempf | 66/77 |
| 3,771,329 | 11/1973 | Krause | 66/78 |
| 3,779,044 | 12/1973 | Schieber | 66/78 |
| 3,789,630 | 2/1974 | Schieber | 66/78 |
| 4,502,300 | 3/1985 | Schmiko et al. | 66/71 |
| 4,510,775 | 4/1985 | Shima | 66/77 |
| 4,526,017 | 7/1985 | Shima | 66/75.2 |

FOREIGN PATENT DOCUMENTS

| | | | |
|---|---|---|---|
| 498056 | 12/1919 | France | 66/78 |
| 201327 | 7/1983 | German Democratic Rep. | 66/75.2 |
| 705388 | 3/1966 | Italy | 66/78 |
| 2136833 | 9/1984 | United Kingdom | 66/78 |

*Primary Examiner*—Ronald Feldbaum

*Attorney, Agent, or Firm*—Jones, Tullar & Cooper

[57] ABSTRACT

A flat-bed knitting machine has been described which is provided with needle sinkers arranged in a knitting cam system of a cam box carriage featuring several cams adjustable by means of stepping motors and having an electronic control unit, which features a storage device for controlling the stepping motors. In order to make the knitting density variable not only in the longitudinal direction, i.e. uniformly as a whole, row by row, but also in the transverse direction across the knitting with knitting machines of this type, the stepping motors are controlled by the storage device, one motor of which, in each case, is associated with a pair of needle sinkers consisting of preceding and trailing needle sinkers during the stroke of the cam box carriage and in synchronism with the individual needles.

11 Claims, 4 Drawing Figures

FLAT-BED KNITTING MACHINE HAVING AN ELECTRONIC CONTROL FOR THE MOVEMENT OF THE NEEDLE SINKER

This is a continuation of co-pending application Ser. No. 657,855 filed on Oct. 5, 1984 now abandoned.

CROSS-REFERENCE TO RELATED APPLICATION

The present application discloses subject mater in common with application, Ser. No. 589,247, now U.S. Pat. No. 4,554,802. The present application and noted patent are commonly assigned.

Technical Field

The present invention relates to a flat-bed knitting machine having needle sinkers arranged in a knitting cam system featuring one or several cams of a cam box carriage, which are moveable by means of stepping motors, and having an electronic control which features a storage device for controlling the stepping motors.

Background of the Invention

For a flat-bed knitting machine of the type described in DE-OS (laid upon application) No. 21 53 429 each needle sinker is rigidly connected to a separate stepping motor, for which the movement of the stepping motor occurs prior to tne actual knitting operation. That means, one of the needle sinkers is withdrawn from operation and the other needle sinker is set into operation at the reversal point of the carriage stroke. As a result, the two stepping motors for the two needle sinkers of a knitting cam are connected to an intermediate store and are connected to a punched tape acting as a program carrier and/or store via a common distribution stage. For this known flat-bed knitting machine the control of the appropriate stepping motor is made during the stroke reversal interval for the following row of knitting, and therefore for all needles which operate in the subsequent row of knitting, jointly and uniformly. This means that the density/tension of the knitting can only alter uniformly as a whole for each row of knitting, for which at the same time, despite this limitation, a relatively high cost/effort for the control in the form of intermediate stores, plus additional components to establish the reversal interval must be effected.

Summary of the Invention

It is an object of the present invention to provide a flat-bed knitting machine of the mentioned type on which it is possible to make the density/tension of the knitting vary not just in the longitudinal direction, i.e., uniformly by rows, but also in a transverse direction across the knitted fabric.

The object is achieved for a flat-bed knitting machine of the above-noted type according to the present invention by controlling at least one stepping motor, associated with a pair of needle sinkers comprising a preceding and trailing needle sinker, during the stroke of the cam box carriage by the storage device in synchronism with the individual needles.

Since the stepping motor and, as a result, the respective operating needle sinker is also moveable during the stroke of the cam box carriage, it is also possible for the flat-bed knitting machine in accordance with the present invention to set the density of the knitting for each individual needle and, as a consequence, for each individual stitch of a row in a variable manner. This enables knitting of virtually any multiplicity to be produced. The technique of patterning can be enriched by new embossed effects due to a deliberately intended variance in the knitting density. It is possible, for example, to form knitting more effectively by equalisation of the edging/border and it is possible to let the thread run more loosely in cases where pieces of knitting run together during the transfer at the edge/border. Consequently, fashioned knitting is less critical as a result of the decrease in strain in the zone of the border. In addition, circular formed edges of collars and decorative borders can be corrected with altered tension in the zone of the border. Furthermore, tucked dresses can be manufactured having fewer gussets, whereby the reduced frequency of gussets are replaced by longer loops/stitches. Once again, this means a considerable increase in production.

In accordance with one variant of the present invention pattern-synchronised needle sinker control can be effected by Jacquard data of individual Jacquard courses. In other words, the needle sinker position allotted to the individual needle is determined by the part of the Jacquard pattern knitted by the respective needle. For example, it is possible with a multi-colored Jacquard pattern to set the pattern-synchronised needle sinker position and, as a result, the knitting density/tension, so that a certain needle sinker position is alloted to each color, such that the individual patterns have in each case a uniform density of knitting, but have a differing density to the neighboring background pattern or to the other neighboring pattern.

In accordance with another variant of the present invention non-pattern-synchronised needle sinker control through random Jacquard data is possible. This means, that the allocation of a needle sinker position to each individual needle is made independent of the knitted pattern given by the Jacquard data. Needle sinker positioning of this kind, independent of the Jacquard pattern, can, for example, enable a certain area within a part of a pattern to be processed having a differing density of knitting; that pieces of knitting running together are, for example, knitted more loosely at the border; that individual stages during gusseting are replaced by longer loops/stitches, and that an identical color "pattern" is superimposed over the multi-colored Jacquard pattern in so far as it represents, for example, a kind of wave formation or simply a convexed form, and the like.

It is also possible to arrange an independent needle sinker control system, which is unsynchronised with the pattern to override the needle sinker control synchronised with the pattern.

The needle sinker position for the non-operating needles can be set such that these needles are not drawn down. This enables the non-operating needles on passing the respective needle sinkers not to be moved again by this, i.e. be drawn down, which means protection for the needles and the thread for one, and for the other, one avoids a long thread and therefore a stretching of the thread, so that in certain cases the subsequent suture/joint has a better appearance and can subsequently be more tightly knitted. In so doing, it is preferable for the needle sinkers to be positioned appropriately for the tightest loop.

Also according to the present invention, a change in the position of the needle sinker can be accomplished over a zone to suit the magnitude of the change in the needle-sinker position such that the center position is always between two needle sinker positions, regardless of the direction of the carriage and the magnitude of the difference. With this feature it is ensured that displacement of the loops does not occur within the same wale.

BRIEF DESCRIPTION OF THE DRAWINGS

Further details and configurations of the present invention are given in the following description in which the present invention is explained and described in more detail with the aid of the following figures illustrating a preferred embodiment

DESCRIPTION OF A PREFERRED EMBODIMENT

Figure 1:
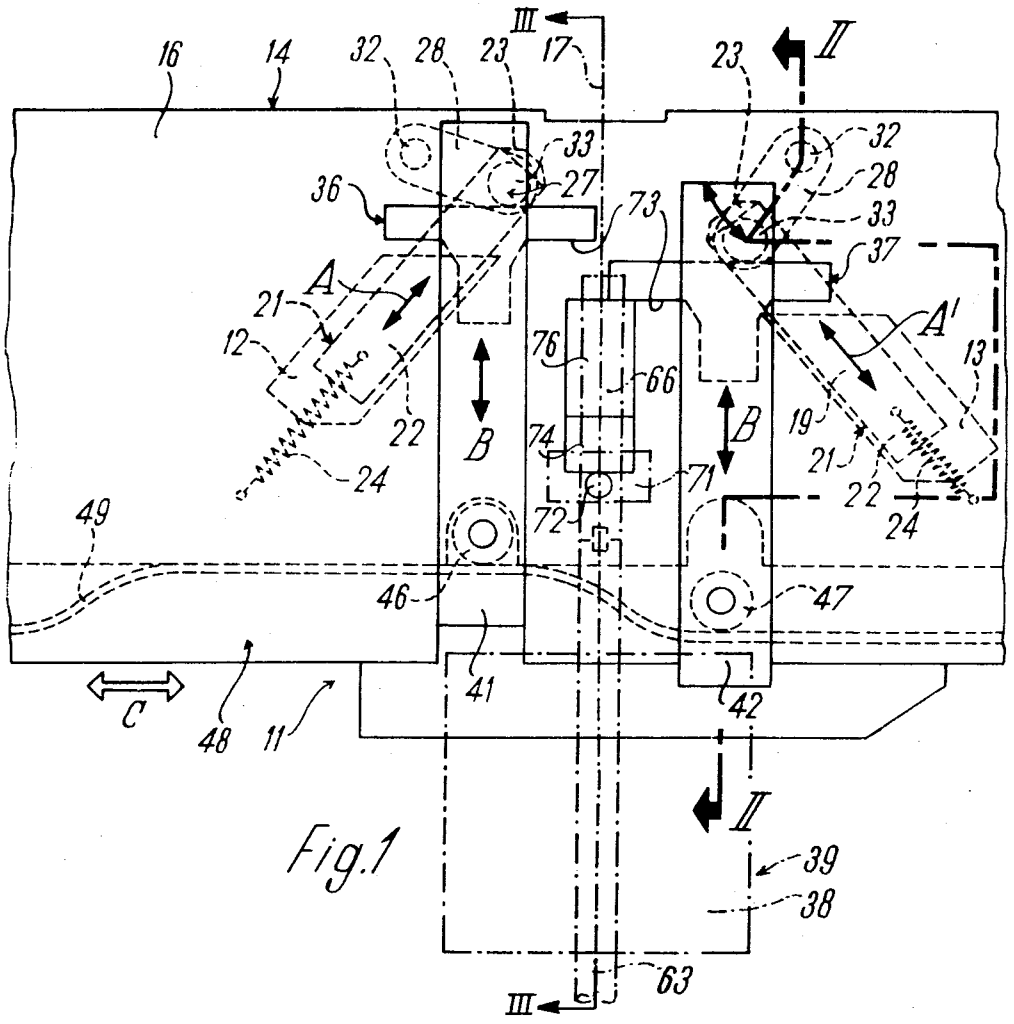
FIG. 1 is a plan view illustrating a cam box carriage of a flat-bed knitting machine which is provided with a needle sinker adjusting device featuring a stepping motor.
Figure 4:
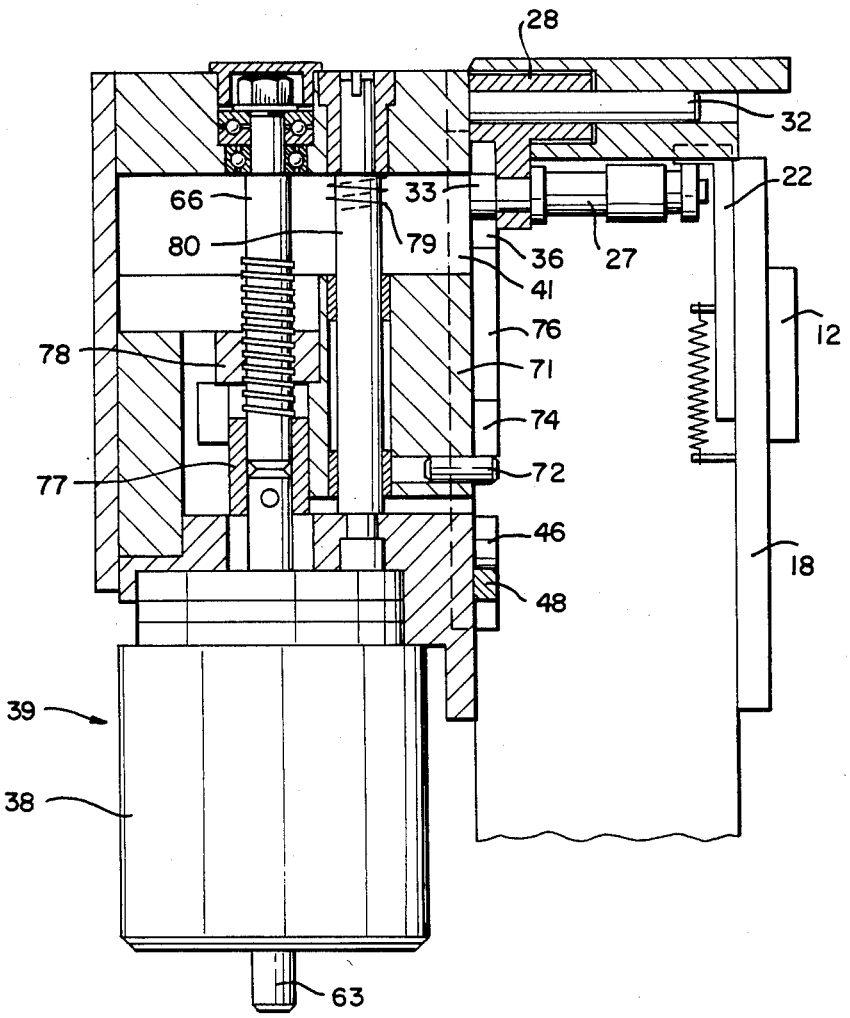
FIG. 4 is a longitudinal section taken along line III—III of FIG. 1.

An adjustment mechanism 11 depicted in the drawing, and in particular FIGS. 1 and 4, in accordance with a preferred example of operation of the present invention for needle sinkers 12, 13 of a flat-bed knitting machine is designed in such a manner that the trailing needle sinker 12 or 13 when in operation can be adjusted in its height during the stroke of the cam box carriage 14 in one or the other direction in relation to the knitting cam in the cam box carriage 14, so that the density of the individual stitches in the individual rows of knitting can not only be variably selected and set, and at the same time knitted correspondingly tight or less tight, but also within each row of knitting.

Basically, only the top, respectively front camplate 16 opposite the needle bed of one of the cam box carriages 14 provided on a flat-bed knitting machine can be seen in FIG. 1, to which the individual elements of the adjusting mechanism 11 for the needle sinkers 12, 13 are fixed, the latter being arranged near an edge of the camplate 16. Of the cam box carriage 14 and/or its camplate 16 only a part showing the needle sinkers 12, 13 with its adjusting mechanism 11 in the region of a cam of the carriage 14 is additionally represented. It is to be understood that the carriage 14 can have one, two or more cams next to each other, and that an adjusting mechanism 11 is associated with each cam.

The two needle sinkers 12, 13 are arranged in a conventional manner symmetrically with respect to a theoretical longitudinal center plane 17 of the relevant cam in a way that they are fitted slanted towards each other and are secured at the back to a bottom, respectively rear camplate, for moving in a guide 19 in the direction of the slanting double arrows A and A'. Each needle sinker 12, 13 is connected to an approximately L-shaped carrier link 21, which can also move in the direction of the double arrow A and A'. The carrier link 21 with its long arm 22 lies on the front side of the rear camplate, therefore opposite the needle sinker 12, 13 which is connected to the carrier link 21 through the rear camplate. The needle sinker 12, 13 or the relative carrier link 21 is connected to a tension spring 24, the other end of which is fixed to a stationary part, for example the rear camplate and which runs in the direction of the double arrow A, A' and in this way tends to pull the needle sinker 12, 13 inwardly to its lowest position.

Under the influence of the tension spring 24 the short arm 23 of the carrier link 21 lies against the rear end of a guide pin 27, which runs in a direction vertical to the needle sinker 12, 13 between the rear and front camplate 18, 16. The guide pin 27 is located to pivot in one end of a guide lever 28 in an end region facing the front camplate 16, whereby the guide pin 27 penetrates the guide lever 28. The other end of the guide lever 28 has an elongated bearing bushing, which is located to pivot on a stationary shaft 32 running parallel to the guide pin 27.

The front end of each guide pin 27 lies over a radial ball bearing 33 against one of two adjusting pieces 36, 37, which can be moved back and forth with the aid of a common stepping motor 38 in a vertical direction as per the double arrow B in accordance with the drawing. Each adjusting piece 36, 37 is connccted to a slide 41, 42, both of which can move parallel to each other as per the double arrow B in the slot 43 of a guide plate (not illustrated) of the drive unit 39 containing the stepping motor shown in dash-dot lines. Each slide 41, 42 is provided with a roller 46, 47 at its end opposite the adjusting piece 36, 37, which operates together with a vertical operating cam-slide 48 provided with a cam track 49. The cam-slide 48, operable back and forth in the direction of the double arrow C, determines if and which needle sinker 12, 13 is operated. The left needle sinker 12 as per FIG. 1 is out of action, since it is pushed via the guide pin 27 and the adjusting piece 36 into its upper most non-operative position, whilst the right needle sinker 13 in FIG. 1 is ready to operate. The cam-slide 48 can also be positioned so that both needle sinkers 12, 13 are out of action, which is the case when the rollers 46, 47 of both slides 41, 42 are pushed up by the cam-slide 48. The return of the slides 41, 42 on release by the cam-slide 48 is effected by the force of the tension spring 24 attached to the carrier link 21.

The drive unit 39 which is fitted on the front camplate 16 has a threaded spindle 66, which is rigidly connected to the output shaft 63 of the stepping motor 38 by way of the connecting sleeve 77 (FIG. 4) to prevent twisting and on which a tapped bushing 71 can move back and forth in an axial direction as per the double arrow B during rotation. A vertical projecting carrier pin 72 is rigidly connected to the non-twisting bushing 71 and operates via blocks 74, 76 in conjunction with the two adjusting pieces 36, 37.

A threaded bushing 78 is mounted on the spindle 66 and is held against rotation in the peripheral direction, so that it can be moved to and fro in an axial direction, as per the double arrow B, by rotation of the spindle 66.

A shaft 80 having a spring 79 at one end is provided as shown in FIG. 4. The upper limit of movement by the busing 78 is determined by the internally threaded bushing 78 becoming disengaged from the external threading in the spindle 66 when the maximum stroke is reached. This means that the external threading terminates at a certain distance from the end of the spindle 66. In order to ensure a simple rethreading of the bushing 78 onto the threading of the spindle 66 when the stepping motor 38 is turned backwards, the spring 79 is provided in the path of the bushing 71 so that is becomes engaged by the bushing 71 as the bushing 78 approaches its maximum stroke. The spring 79 is of such a length that it is compressed to a certain degree even before the bushing 78 becomes unthreaded from the spindle 66, so that the counter-pressure produced by the spring 79 after the bushing 78 has become unthreaded exerts an axial force on the bushing 78 to encourage rethreading to take place.

Figure 2:
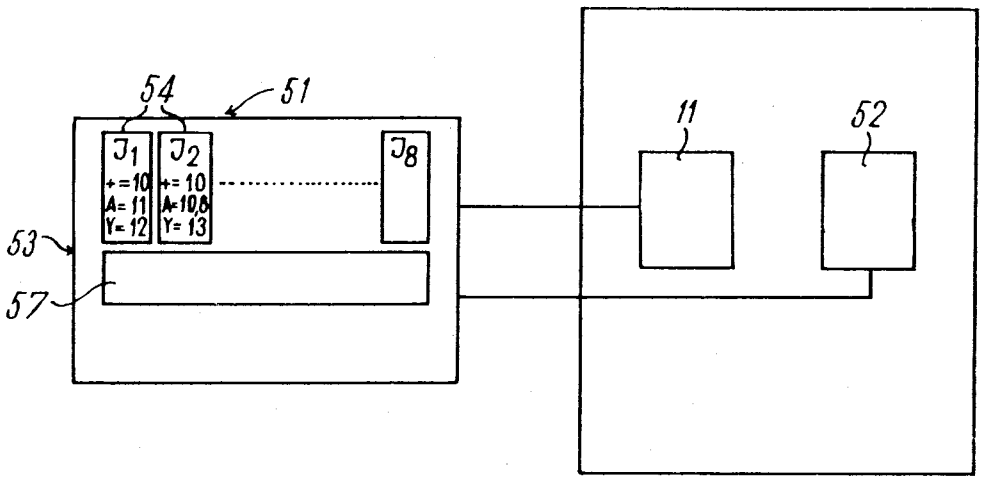
FIG. 2 is a block schematic diagram for controlling the needle sinker adjustment device shown in FIG. 1.

In accordance with FIG. 2 the adjusting mechanism 11 and/or its stepping motor 38 for each cam is controlled with the aid of a control unit 51 during the stroke of the cam box carriage 14 and in needle synchronisation, i.e., in synchronism with each individual needle. Therefore, the control unit 51 is connected, on the one hand, with the adjusting mechanism(s) 11 of the flat-bed knitting machine and, and on the other hand, with a needle synchronisation unit 52. The control unit 51 comprises a storage device 53 in which the values allotted to the individual needles for the needle sinker positions per cam are stored. These values for the needle sinker positions stored in it are selected from knitting tension values of, for example, 8 to 15, of which the value 8 represents the tightest position and the value 15 is the loosest position. These constructive numbers are graduated in 1/10 divisions. As a result, 70 needle sinker position combinations are thus formed in total.

The storage device 53 is filled, for example, en bloc with a certain chosen number. Within the storage device 53 are fitted, for example, up to eight store parts 54 (J1, J2, . . . ) in which a certain needle sinker position is associated to be the appropriate data of the Jacquard pattern of the individual Jacquard course for pattern synchronised needle sinker control and/or positioning in each cam. This means, that to each symbol (e.g. +, A, Y,) of the Jacquard pattern, which in each case represents, for example, another color in a multi-colored Jacquard pattern, belongs a certain defined needle sinker position for the relevant cam. This is shown, for example, with the aid of the Jacquard pattern J1 and J2 in FIG. 2. As a result, a density of knitting is produced which changes with the pattern and which is always the same for the same parts of the pattern, but differs in relation to the neighboring pattern parts. Because of this, not only the pattern color, but also the needle sinker position and, as a result, the density of the knitting is associated to the individual symbols or data, and/or predetermined independent of each other.

A higher level store part 57 is incorporated within the storage device 53, working independently of, or in conjunction with the store parts 54 and which is provided for independent needle sinker control and/or positioning in each cam through random Jacquard data which is valid only for the needle sinker, unsynchronised with the pattern. Within this store part 57 are stored the needle sinker positions as control values for the stepping motor 38 which are associated in synchronism with the individual needles, which, however, are operable independent of the Jacquard data of the Jacquard pattern. In other words, the density of the knitting can be altered over the knitting in, for example, a region within a certain part of a pattern, at the border of the knitting or in a certain form, such as wave-shaped, by this store part 57.

A multi-colored Jacquard pattern can be knitted either with a single cam flat-bed knitting machine in several passes or with a multi-cam flat-bed knitting machine in a single pass, for which, in the latter case, a certain color is associated with each cam. To the non-operating needles in a cam in each case a needle sinker position is allotted, such that the non-operating needles are not drawn, i.e., moved when passing the respective needle sinker. The needle sinker is then advantageously equal to the tightest tensioned knitting. This applies of course to single colored Jacquard patterns as well.

Figure 3:
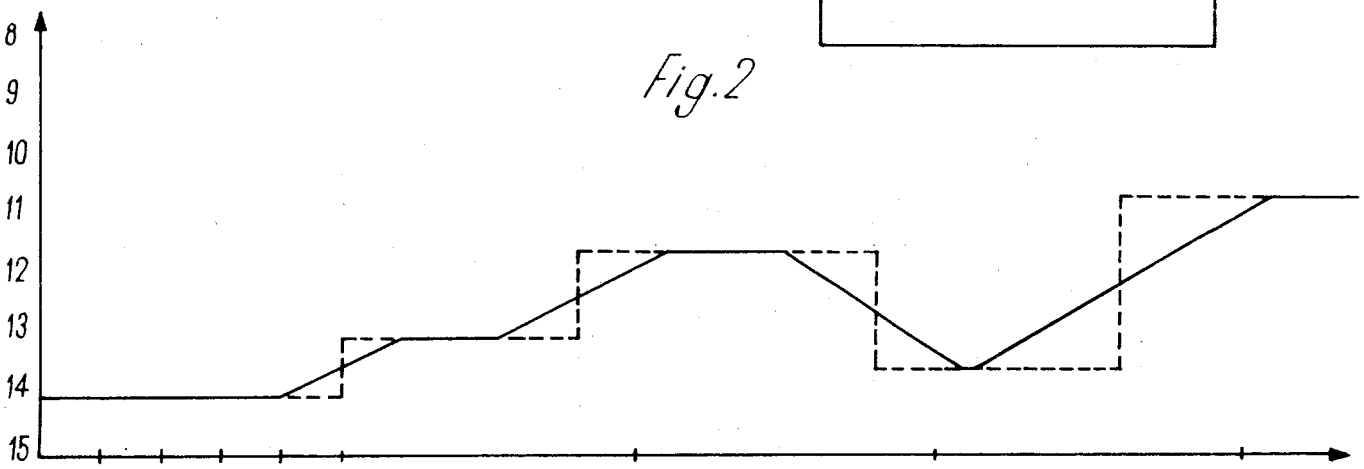
FIG. 3 is a schematic graphic presentation illustrating a possible path of the tension of the knitting over the length of the needle bed.

FIG. 3 shows, on the one hand, the theoretical change in the knitting tension in dotted and, on the other hand, the actual path of the needle sinker positions in full line over the individual needles depicted over the length of the needle bed with the aid of a graph of the knitting tension. This occurs due to the more limited speed of movement of the stepping motor in relation to the transversing speed of the carriage, seen over a needle division/trick. In other words, it does not just jump but changes gradually at the transition from one desired knitting density to another, in which this respective path of transition is dependent upon the magnitude of the difference in needle sinker positions and is arranged symmetrically to the theoretical sudden change of path and is calculated so that the needle sinker center position is between two values of adjustment always at the same needle, regardless of the carriage direction. This applies both to the transition from one knitting density to another as well as to the transition visible only indirectly on the knitting from operating to non-operating needles.

What is claimed is:

1. In a flat-bed knitting machine, the combination comprising:

a knitting cam system having a cam box carriage having at least one cam and a pair of needle sinkers associated therewith;

a stepping motor for each cam, connected to the cam box carriage, for moving its respective cam; and an electronic controller connected to each stepping motor, said electronic controller including a storage device for controlling the stepping motor during the stroke of its respective cam box carriage to thereby control the position of the needle sinkers in synchronism with the individual needles of the needle sinkers.

2. The combination as defined in claim 1, wherein a change in the position of each needle sinker can be accomplished over a zone to suit the magnitude of the change in the needle sinker position, such that the center position is always between two needle sinker positions, irrespective of the direction of the cam box carriage and the magnitude of the difference.

3. The combination as defined in claim 1, wherein each needle sinker has a non-operating position and wherein the needle sinkers are not drawn down when in the non-operating position.

4. The combination as defined in claim 3, wherein a change in the position of each needle sinker can be accomplished over a zone to suit the magnitude of the change in needle sinker positions, such that the center position is always between two needle sinker positions, irrespective of the direction of the cam box carriage and the magnitude of the difference.

5. The combination as defined in claim 1, wherein the controlled positions of the needle sinkers by the electronic controller are independent of the Jacquard pattern(s) to be produced.

6. The combination as defined in claim 5, wherein each needle sinker has a non-operating position and wherein the needle sinkers are not drawn down when in the non-operating position.

7. The combination as defined in claim 6, wherein a change in the position of each needle sinker can be accomplished over a zone to suit the magnitude of the change in the needle sinker position, such that the center position is always between the needle sinker positions irrespective of the direction of the cam box carriage and the magnitude of the difference.

8. The combination as defined in claim 1, wherein the controlled positions of the needle sinkers by the electronic controller are associated with a Jacquard pattern(s) to be produced.

9. The combination as defined in claim 8, wherein each needle sinker has a non-operating position and wherein the needle sinkers are not drawn down when in the non-operating position.

10. The combination as defined in claim 9, wherein a change in the position of each needle sinker can be accomplished over a zone to suit the magnitude of the change in the needle sinker position such that the center position is always between two needle sinker positions, irrespective of the direction of the cam box carriage and the magnitude of the difference.

11. In a flat-bed knitting machine, the combination comprising:

a knitting cam system having a cam box carriage having at least one cam and a pair of needle sinkers asssociated therewith;

a stepping motor for each cam, connected to the cam box carriage, for moving its respective cam;

a needle synchronising unit; and an electronic controller connected to each stepping motor and to the needle synchronising unit, said electronic controller including a storage device for controlling the stepping motor during the stroke of its respective cam box carriage to thereby control the position of the needle sinkers in synchronism with the individual needles of the needle sinkers.

* * * * *